US007198574B2

(12) United States Patent
Barbosa

(10) Patent No.: US 7,198,574 B2
(45) Date of Patent: Apr. 3, 2007

(54) PUTTER WITH INTEGRAL BALL RETRIEVER

(76) Inventor: Carlos Barbosa, 647 Pamela Kay Ln., La Puente, CA (US) 91746

( * ) Notice: Subject to any disclaimer, the term of this patent is extended or adjusted under 35 U.S.C. 154(b) by 0 days.

(21) Appl. No.: 11/111,526

(22) Filed: Apr. 20, 2005

(65) Prior Publication Data

US 2006/0240904 A1 Oct. 26, 2006

(51) Int. Cl.
*A63B 53/04* (2006.01)
*A63B 47/02* (2006.01)

(52) U.S. Cl. ..... 473/286; 473/252; 473/340; 294/19.2

(58) Field of Classification Search ..... 473/340–341, 473/286, 252, 345, 350; 294/19.2
See application file for complete search history.

(56) References Cited

U.S. PATENT DOCUMENTS

| | | | | |
|---|---|---|---|---|
| 3,300,241 | A | 1/1967 | Eberwein et al. | |
| 3,374,027 | A | 3/1968 | Jacobs | |
| 3,436,077 | A * | 4/1969 | Geram | 473/176 |
| 3,632,112 | A | 1/1972 | Jacobs | 273/162 E |
| 4,248,430 | A | 2/1981 | Kepler | 273/162 |
| 4,934,702 | A * | 6/1990 | Serizawa | 473/251 |
| 4,962,927 | A | 10/1990 | Colucci | 273/162 |
| 4,976,436 | A * | 12/1990 | Serizawa | 473/286 |
| 5,269,525 | A | 12/1993 | Hull et al. | 273/162 |
| 5,368,302 | A | 11/1994 | Thomas | 273/162 |
| D364,666 | S * | 11/1995 | Nagy | D21/743 |
| 5,485,999 | A | 1/1996 | Hull et al. | 273/162 |
| 5,509,658 | A | 4/1996 | Youngblood | 473/286 |
| 5,628,696 | A | 5/1997 | Frye | 473/286 |
| D424,145 | S * | 5/2000 | Minami | D21/744 |
| 6,322,457 | B1 | 11/2001 | Klein | 473/286 |
| 6,402,638 | B1 | 6/2002 | Kelley | 473/330 |
| 6,634,955 | B2 | 10/2003 | Middleton | 473/231 |
| 6,648,776 | B1 * | 11/2003 | Boehm et al. | 473/374 |
| 6,860,817 | B2 | 3/2005 | Middleton | 473/231 |
| 6,878,072 | B1 * | 4/2005 | Henry | 473/286 |
| 2006/0063607 | A1 * | 3/2006 | Crossley | 473/340 |

* cited by examiner

*Primary Examiner*—Stephen Blau
(74) *Attorney, Agent, or Firm*—Edgar W. Averill, Jr.; Kenneth L. Green

(57) ABSTRACT

A golf club includes a head having a golf ball retriever integrated into the head. The retriever comprises a substantially vertical and substantially frusto conical passage (or throat) radially enclosed in the bottom the head. Because variations exist in regulation golf ball size and exterior, the diameter and taper of the throat is selected to be suitable for a variety of golf balls. A release hole extends though the head from the throat to a top surface of the head, and allows easy ejection of a ball from the throat. The head further includes aligning (or aiming) marks on opposite sides of the release hole to facilitate aligning the head for a stroke.

20 Claims, 2 Drawing Sheets

PUTTER WITH INTEGRAL BALL RETRIEVER

BACKGROUND OF THE INVENTION

The present invention relates to a ball retriever and in particular to a putter head including an integral ball retriever and ball aligning marks.

The game of golf is enjoyed by many youths, adults, and senior citizens. Some of the main benefits of golf are the enjoyment of the outdoors and improved health from remaining active as one ages. Unfortunately, as one ages, various old age maladies such as arthritis and rheumatism limit the ability to bend over, such as bending over to retrieve a golf ball from, for example, the putting green or from the inside of the cup.

Several golf ball retrievers are known. For example, U.S. Pat. No. 1,722,519 for "Device for Retrieving Golf Balls," U.S. Pat. No. 1,830,520 for "Device for Picking Up Golf Balls and Like Articles," and U.S. Pat. No. 5,437,488 for "Portable Golf Ball Retriever," all describe a device with a shaft and a grasping member on the end of the shaft for retrieving golf balls. Unfortunately, a dedicated retriever adds to the articles carried by a golfer, and has not been generally accepted by golfers for retrieving golf balls. Other devices attach to the grip end of golf clubs, but have been found to interfere with gripping the club.

Other known solutions comprise golf clubs with features included for retrieving golf balls. U.S. Pat. No. 4,580,784 for "Golf Club Including Ball Retrieving Devices," and U.S. Pat. No. 6,379,259 for "Golf Putter," describe golf clubs which scoop up a golf ball. Unfortunately, such scooping often results in a frustrating series of motions which fail to retrieve the ball or may damage the edges of the cup or hole by pressing against the edge to scoop the ball. U.S. Pat. No. 3,374,027 for "Golf Ball Retrieving Club," describes a club with a hemispherical cavity on the clubs bottom, which cavity is intended to grasp a golf ball when the cavity of forced over the golf ball. The gasping depends on the precise interference fit between golf ball holders along the mouth of the cavity and the golf ball. Unfortunately, golf balls have some variation in size and surface, and the dependence on the precise interference fit is only suitable for a particular size ball.

U.S. Pat. No. 3,632,112 for "Golf Ball Retrieving Club," describes a club with a tapered cavity having an opening to the rear. The tapered throat has a taper of "a few thousandths of an inch." The taper is thus described only in generalities, and no specific dimensions suitable for known golf balls are provided. Unfortunately, because of the variation in known golf balls, and because of the requirements for a suitable interference fit, a small range of diameter and taper is required to achieve a useful device, and such is not disclosed in the '112 patent. Further, because the club of the '112 patent describes a large gap at the rear of the throat, only a single aligning (or aiming) mark may be provided for aligning the club with the ball. Additionally, the entry of the ball into the throat is not limited, and therefore the ball may be seated too deep in the throat and be difficult to remove, or the ball may push through the throat and be difficult to retrieve.

BRIEF SUMMARY OF THE INVENTION

The present invention addresses the above and other needs by providing a golf club which includes a head having a golf ball retriever integrated into the head. The retriever comprises a substantially vertical and substantially frusto conical passage (or throat) radially enclosed in the bottom the head. Because variations exist in regulation golf ball size and exterior, the diameter and taper of the throat is selected to be suitable for a variety of golf balls. A release hole extends though the head from the throat to a top surface of the head, and allows easy ejection of a ball from the throat. The head further includes aligning (or aiming) marks on opposite sides of the release hole to facilitate aligning the head for a stroke.

In accordance with one aspect of the invention, there is provided a golf club with a golf ball retriever integrated into the golf club head. The golf club includes a radially enclosed, substantially frusto conical, and substantially vertical throat, a release opening substantially horizontally centered on the throat and extending through the head from the throat to a top surface of the head, and aligning marks on opposite sides of the release opening. The aligning marks comprise lines residing on a top surface of the club, approximately centered with respect to the face, and approximately orthogonal to the face. The lines comprise a first line residing between the release opening and the face and a second mark on an opposite side of the release opening.

In accordance with one aspect of the invention, there is provided a golf club with a golf ball retriever integrated into the golf club head. The golf ball retriever comprises a radially enclosed, substantially frusto conical, and substantially vertical throat and a release opening substantially horizontally centered and extending through the head from the throat to a top surface of the head. The throat is between approximately 1.680 inches and approximately 1.685 inches in diameter and between approximately 0.825 inches and approximately 0.850 inches deep, and having between approximately 1 degree taper and approximately 1.5 degree taper down from a mouth of the throat.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
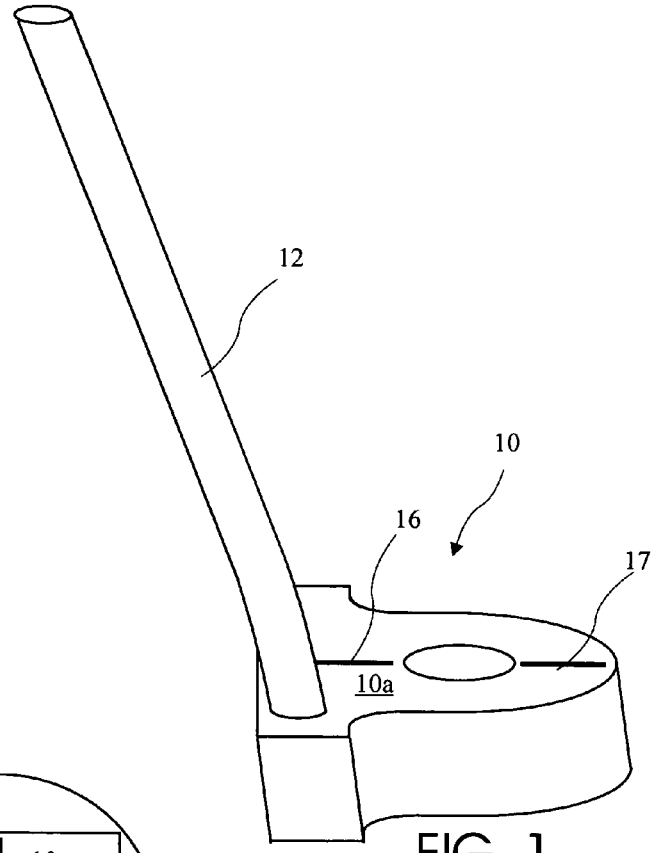
FIG. 1 is a perspective view of a golf club head with an integrated golf ball retriever according to the present invention.
Figure 2:
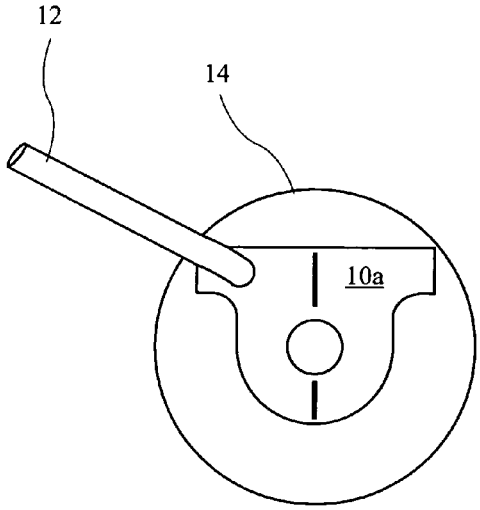
FIG. 2 is a top view of the golf club head in a golf cup.

FIG. 1 is a perspective view of a golf club head 10 with an integrated golf ball retriever according to the present invention. The head 10 is attached to a shaft 12 and includes aligning (or aiming) marks 16 and 17 which reside on a top surface 10*a* of the head 10. The head 10 is further preferably a putter head. A top view of the golf club head 10 in a golf cup 14 is shown in FIG. 2. Advantageously, the head 10 fits within the cup 14 to allow a golf ball to be retrieved from the cup 14.

Figure 3A:
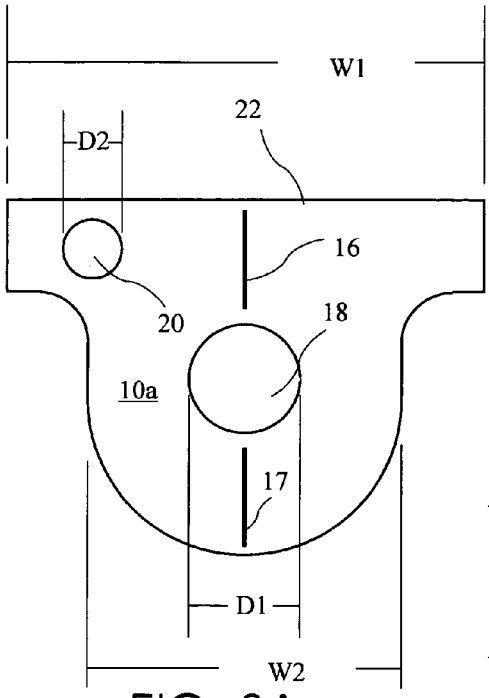
FIG. 3A is a top view of the golf club head.
Figure 3C:
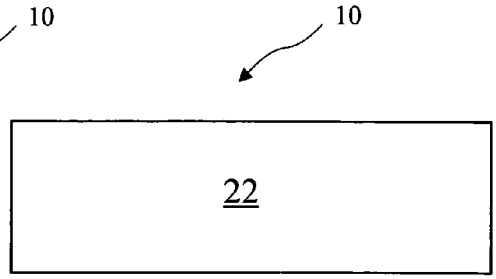
FIG. 3C is a front (or face) view of the golf club head.
Figure 3D:
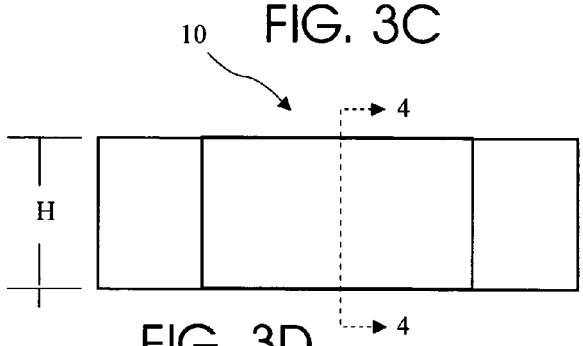
FIG. 3D is a rear view of the golf club head.
Figure 3B:
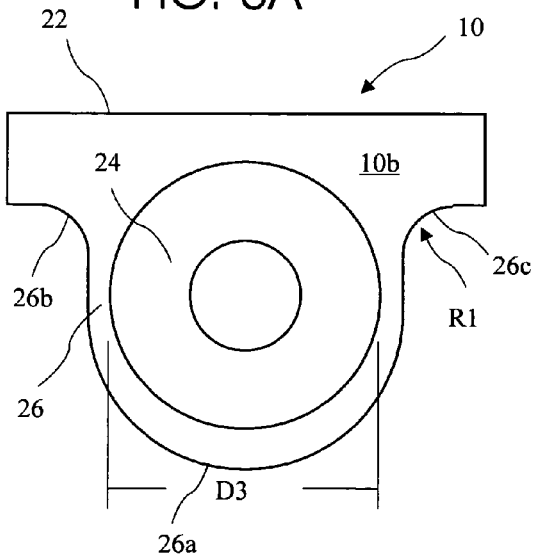
FIG. 3B is a bottom view of the golf club head.
Figure 3E:
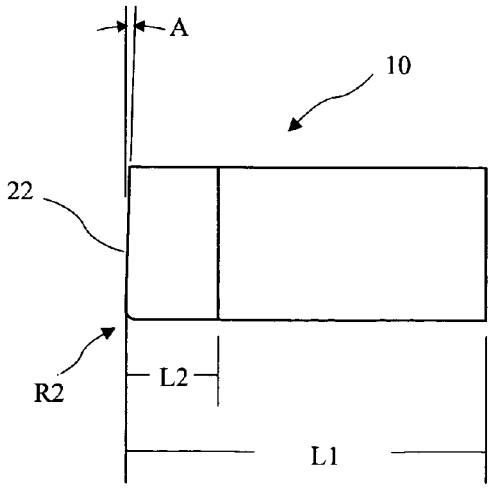
FIG. 3E is a side view of the golf club head.

A top view of the golf club head 10 is shown in FIG. 3A, a bottom view of the head 10 is shown in FIG. 3B, a front (or face) view of the head 10 is shown in FIG. 3C, a rear view of the head 10 is shown in FIG. 3D, and a side view of the head 10 is shown in FIG. 3E. The head 10 has an overall width W1, an overall length L1, and a height H. The width W1 is preferably between approximately 2.96 inches and approximately 2.98 inches, and is more preferably approximately 2.97 inches. The height H is preferably between approximately 0.94 inches and approximately 0.96 inches, and is more preferably approximately 0.95 inches.

The head 10 includes a face 22 for striking a golf ball. The face 22 is preferably rectangular, and preferably leans back at an angle A for adding a small amount of lift to the golf ball. The angle A is preferably between approximately one degree and approximately 1.5 degrees, and is more preferably approximately one degree. The lower edge of the face 22 is preferably radiused with a radius R2 to reduce or prevent catching the head 10 on a grass surface during a swing. The radius R2 is preferably approximately ⅛ inches. The face 22 had a depth L2, which L2 is preferably between approximately 0.55 inches and approximately 0.58 inches and is more preferably approximately 0.58 inches. The head 10 has a narrow portion 26 opposite the face 22, wherein the narrow portion 26 includes a convex surface 26*a* opposite the face 22 and concave surfaces 26*b* and 26*c* on each side of the convex surface 26*a* and flaring out to the overall width W1. The convex surface 26*a* has a width W2 which is less than the width W1 and the concave surfaces 26*b* and 26*c* have a radius R1, which radius R1 is preferably approximately 5/16 inches.

A shaft hole 20 resides on a top surface 10*a* of the head 10, and receives the shaft 12. The shaft hole 20 has a diameter D2 adapted for standard shafts, and the diameter D2 is preferably approximately 0.37 inches with a depth of approximately 0.5 inches, but may be any diameter suitable for receiving a shaft 12. The shaft hole 20 is preferably centered approximately between approximately 0.29 inches and approximately 0.31 inches from the face 22, and more preferably approximately 0.3 inches from the face 22, and approximately 0.550 inches inboard from the side of the head 10. The shaft hole 20 may be on a left side of the head 10 for a right handed golfer, or on the right side of the head 10 for a left handed golfer. The shaft 20 is preferably held in the shaft hole 20 by epoxy adhesive. The shaft hole 20 may be orthogonal to the top surface 10*a* and the shaft 12 is curved as needed, or the shaft hole 20 may be angled. A mouth 24 in a bottom surface 10*b* of the head 10 is provided to allow a golf ball to enter a throat 20 (see FIG. 4) of the head 10. The mouth 24 diameter D3 is preferably between approximately 1.68 inches and approximately 1.685 inches in diameter, and is more preferably 1.68 inches in diameter.

A release opening 18 is provided in a top surface 10*a* of the head 10 to allow a user to release a golf ball retrieved by the head 10. The release opening 18 has a diameter D1 sufficiently large to allow a thumb and/or finger and/or golf Tee to be inserted into and/or through the release opening 18 to apply pressure to a golf ball retrieved by the head 10 and the diameter D1 is preferably substantially smaller than the diameter of the throat 28 (see FIG. 4) to provide a limit to the advance of a golf ball into the throat 26. Thus limiting the advance of the golf ball into the throat 28 prevents the ball from being seated too deep within the throat 28 making removing the ball difficult, and preventing the ball from pushing through the throat making retrieving the ball difficult. The diameter D1 is preferably is between ⅓ and ½ of the diameter of the throat, and more preferably between approximately 0.7 inches and approximately 0.75 inches, and D1 is most preferably approximately 0.7 inches.

The aligning marks 16 and 17 preferably comprise lines residing on the top surface 10*a* of the head 10 and are preferably approximately centered with respect to a face 22 of the club head 10, and approximately orthogonal to the face 22. The aligning marks 16 and 17 preferably comprise a first line 16 residing between the face 22 and the release opening 18 and a second line 17 on an opposite side of the release opening 18. The lines are preferably notches in the top surface 10*a*, and more preferably a "V" notch between approximately 0.04 inches and 0.05 inches deep and preferably approximately 50 degrees wide. The lines 16 and 17 are preferably aligned with the center of the release opening 18 and preferably aligned with each other.

Figure 4:
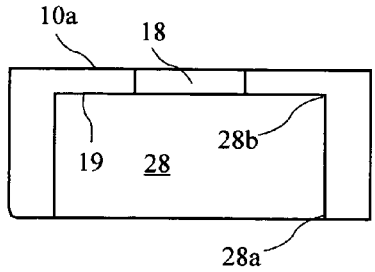
FIG. 4 is a cross-sectional view of the golf club head taken along line 4—4 of FIG. 3D.

A cross-sectional view of the golf club head 10 taken along line 4—4 of FIG. 3D is shown in FIG. 4. The throat 28 is substantially frusto conical and substantially vertical and is preferably radially enclosed (i.e., forms a complete circle with no gaps). Although the throat 28 need not be perfectly frusto conical, it is sufficiently frusto conical to function as a frusto conical throat would function in terms of grasping a golf ball. Similarly, the throat 28 need not be exactly vertical, but is sufficiently vertical to allow a vertical motion of the head 10 to move the throat 18 down over a golf ball. The throat 28 is further preferably horizontally centered on the face 22 (see FIG. 3B). A shoulder 19 connects the release opening 19 and the throat 28. The shoulder 19 is preferably a flat and/or horizontal shoulder.

The throat 28 has a first throat diameter 28*a* proximal to the mouth 24, and a second throat diameter 28*b* proximal to the release opening 18. Modern regulation golf balls have a small range is diameters and may have different surface characteristics. In order to grasp such golf balls, the throat 28 preferably has a diameter and taper which allow entry of the balls into the throat 28, and which provides a friction fit sufficient to retain the balls in the throat 28. The first throat diameter 28*a* is preferably between approximately 1.675 inches and approximately 1.69 inches in diameter, and is more preferably approximately 1.68 inches in diameter. The second throat diameter 28*b* is preferably between approximately 1.68 inches and approximately 1.685 inches in diameter, and is more preferably approximately 1.675 inches in diameter. The throat 28 preferably tapers down from the first throat diameter 28*a* to the second throat diameter 28*b* at between an approximately 1 degree taper and an approximately 1.5 degree taper, and more preferably tapers down at approximately one degree of taper. The throat 28 is preferably between approximately 0.775 inches and approximately 0.8 inches deep.

While the invention herein disclosed has been described by means of specific embodiments and applications thereof, numerous modifications and variations could be made thereto by those skilled in the art without departing from the scope of the invention set forth in the claims.

I claim:

1. A golf club having a golf club head with a golf ball retriever integrated into the golf club head, comprising:

a golf club face;

a substantially frusto conical and substantially vertical throat in the golf club head, the throat sized to accept and hold a variety of regulation golf balls;

a release opening extending through the golf club head from the throat to a top surface of the golf club head and having a substantially smaller diameter than the throat, the release opening for releasing a golf ball from the throat; and a shoulder between the throat and the release opening.

2. The golf club of claim 1, wherein:

the release opening has a release opening diameter sufficiently small to limit the advance of the golf ball into the throat.

3. The golf club of claim 2, wherein release opening diameter is between ⅓ and ½ the diameter of the throat diameter.

4. golf club of claim 2, wherein release opening diameter is between approximately 0.7 inches and approximately 0.75 inches.

5. The golf club of claim 1, wherein:

the golf club head has a face for striking golf balls; and the throat is substantially centered with respect to the face.

6. The golf club of claim 5, wherein the release opening is approximately horizontally centered on the throat.

7. The golf club of claim 6, wherein:

the aligning marks comprise lines approximately orthogonal to the face; and the aligning marks comprise a first line between the release opening and the face and a second line on an opposite side of the release opening.

8. The golf club of claim 1 wherein:

the golf club face has a first width;

the golf club head includes a narrow portion opposite the golf club face and having a second width smaller than the first width;

the narrow portion includes a convex surface opposite the face and concave surfaces on each side of the convex surface;

the concave surfaces flare out to the first width.

9. The golf club of claim 1, wherein the throat is between approximately 0.775 inches deep and approximately 0.8 inches deep.

10. The golf club of claim 9, wherein the shoulder is recessed between approximately 0.775 inches and approximately 0.8 inches above a bottom surface of the golf club head.

11. The golf club of claim 10, wherein: the throat includes a mouth proximal to a bottom surface of the golf club head; and the mouth is approximately 1.68 inches in diameter.

12. The golf club of claim 1, wherein the throat is radially enclosed.

13. The golf club of claim 1, wherein:

the throat includes a mouth proximal to a bottom surface of the head; and the throat tapers down from the mouth at between an approximately 1 degree taper and an approximately 1.5 degree taper.

14. The golf club of claim 13, wherein the throat tapers down from the mouth at an approximately 1 degree taper.

15. The golf club of claim 1, wherein the club is a putter.

16. The golf club of claim 15, wherein the golf club head includes a substantially rectangular face.

17. A golf club head with a golf ball retriever integrated into the golf club head, comprising:

a face for striking golf balls;

a radially enclosed, substantially frusto conical, and substantially vertical throat having a first diameter proximal to a mouth and, a smaller second diameter opposite the first diameter and a release opening substantially horizontally centered on the throat and extending through the golf club head from the throat to a top surface of the golf club head and having a smaller diameter than the throat and limiting the advance of the golf ball into the throat; and a shoulder between the throat and the release opening, wherein the shoulder is recessed between approximately 0.775 inches deep and approximately 0.8 inches deep into the throat from a bottom surface of the golf club head.

18. The golf club of claim 17, wherein:

the aligning marks comprise lines residing on a top surface of the golf club head, are approximately centered with respect to the face, and approximately orthogonal to the face; and the lines comprise a first line residing between the release opening and the face and a second line on an opposite side of the release opening.

19. The golf club of claim 17, wherein release opening diameter is between ⅓ and ½ the diameter of the throat diameter.

20. A golf club with a golf ball retriever integrated into the golf club head, comprising:

a face for striking golf balls;

a radially enclosed, substantially frusto conical, and substantially vertical throat between approximately 1.675 inches and approximately 1.69 inches in diameter, and having between approximately 1 degree taper and approximately 1.5 degrees taper down from a mouth of the throat;

a release opening substantially horizontally centered and extending through the head from the throat to a top surface of the golf club head and having a release opening diameter is between ⅓ and ½ the diameter of the throat diameter and a shoulder connecting the throat and the release opening.

* * * * *